US006830063B1

(12) United States Patent
Ball

(10) Patent No.: US 6,830,063 B1
(45) Date of Patent: Dec. 14, 2004

(54) FREEZELESS PROTECTION DEVICE FOR WALL HYDRANTS/FAUCETS

(75) Inventor: William T. Ball, Colorado Springs, CO (US)

(73) Assignee: WCM Industries, Inc., Colorado Springs, CO (US)

( * ) Notice: Subject to any disclaimer, the term of this patent is extended or adjusted under 35 U.S.C. 154(b) by 0 days.

(21) Appl. No.: 10/682,173

(22) Filed: Oct. 9, 2003

(51) Int. Cl.[7] ..... E03B 7/10; E03B 9/14; F16L 55/00

(52) U.S. Cl. ..... 137/301; 137/59; 137/60; 137/62; 137/360; 137/375; 138/32

(58) Field of Search ..... 137/79, 59, 60, 137/61, 62, 218, 301, 302, 360, 375; 138/27, 32

(56) References Cited

U.S. PATENT DOCUMENTS

| | | | | | |
|---|---|---|---|---|---|
| 21,858 | A | * | 10/1858 | Swan | 137/301 |
| 1,021,537 | A | | 3/1912 | Lawnin | |
| 1,069,003 | A | | 7/1913 | Haennig | |
| 1,433,110 | A | | 10/1922 | Buckler | |
| 1,828,763 | A | | 10/1931 | Carner | |
| 2,599,325 | A | * | 6/1952 | Fritzberg | 138/28 |
| 2,629,402 | A | * | 2/1953 | Cook | 138/28 |
| 2,688,976 | A | * | 9/1954 | Baker | 137/301 |
| 2,730,326 | A | | 1/1956 | Staben | |
| 3,070,116 | A | | 12/1962 | Noland et al. | |
| 3,244,192 | A | | 4/1966 | Noland | |
| 3,380,464 | A | | 4/1968 | Arterbury | |
| 3,392,745 | A | * | 7/1968 | Noland | 137/301 |
| 3,407,837 | A | * | 10/1968 | Fulton et al. | 137/301 |
| 3,480,027 | A | * | 11/1969 | Noland | 137/59 |
| 3,983,896 | A | * | 10/1976 | Harrington | 137/301 |
| 4,182,356 | A | | 1/1980 | Woodford, Sr. | |
| 4,483,361 | A | | 11/1984 | Jungbert, Sr. | |
| 4,649,959 | A | * | 3/1987 | Wadleigh | 138/28 |
| 4,700,732 | A | | 10/1987 | Francisco | |
| 4,776,362 | A | | 10/1988 | Domingue et al. | |
| 4,909,270 | A | | 3/1990 | Enterante et al. | |
| 5,058,627 | A | * | 10/1991 | Brannen | 138/27 |
| 5,241,981 | A | | 9/1993 | Ahern | |
| 5,551,473 | A | | 9/1996 | Lin et al. | |
| 6,142,172 | A | | 11/2000 | Shuler et al. | |
| 6,338,364 | B1 | * | 1/2002 | Mendenhall | 138/32 |
| 6,363,960 | B1 | | 4/2002 | Gauss | |
| 6,532,986 | B1 | | 3/2003 | Dickey et al. | |

FOREIGN PATENT DOCUMENTS

| | | |
|---|---|---|
| CA | 447072 | 3/1948 |
| DE | 344054 | 11/1921 |
| DE | 294986 | 10/1936 |
| FR | 1124914 | 10/1956 |

* cited by examiner

*Primary Examiner*—George L. Walton

(57) ABSTRACT

A freezeless wall hydrant is provided that has an elongated inlet pipe comprised of a hollow tube. The tube is connected to a valve and fitting assembly on its inner end for connection to a source of water under pressure. On the outer end, the tube is connected to an adjusting element with an outlet port that is associated with the valve and fitting assembly to open or close the tube to fluid flow and allow for fluid flow out of the tube when the valve is in the open position. The tube is comprised of a flexible material that enlarges in diameter in an area along its length when it is subjected to trapped fluid therein under high pressure so that the tube will not rupture. The tube returns to its normal diameter after the high fluid pressure therein is abated.

4 Claims, 3 Drawing Sheets

FREEZELESS PROTECTION DEVICE FOR WALL HYDRANTS/FAUCETS

BACKGROUND OF THE INVENTION

This invention relates generally to wall hydrants and faucets and, more particularly, to a freezeless protection device for wall hydrants and faucets.

Freezeless wall hydrants and faucets have long been in existence. They characteristically have a fluid closure valve located in the end of an inlet pipe located within the wall or a warmer interior area of the building of which the wall is a part. This closure valve is operated by an elongated rod connected to an exterior handle. The freezeless characteristics of the hydrant are caused by the closure valve shutting off the flow of water within the wall or building at a freezing temperature, with the residual water in the inlet pipe flowing by gravity outwardly through the conventional outlet drain of the hydrant.

The foregoing structure works very successfully except in situations where a hose or the like is attached to the outlet drain of the hydrant, whereupon the residual water is not able to easily flow by gravity out of the hydrant when the closure valve connected to the pressurized water is closed. With a hose attached during freezing weather, the residual water freezes within the hydrant, and the inlet pipe or related components thereupon rupture from the freezing conditions within the hydrant.

It has in recent times been recognized that the rupture of such a hydrant under freezing weather conditions does not take place because of the frozen water in the hydrant. Rather, the rupture results from the ice imposing severe pressure on the captivated non-frozen fluid in the inlet pipe. Thus, the increased pressure on this water by the expanded ice is the principal cause for the rupture of the hydrant.

It is therefore a principal object of this invention to provide a freezeless wall hydrant which has the ability to relieve the pressure on the residual water located inwardly of frozen residual water located outwardly thereof when that water freezes by reason of a hose or the like being attached to the discharge nozzle.

A further object of this invention is to provide a freezeless wall hydrant which has the ability to relieve the pressure on residual water located inwardly of frozen residual water located outwardly thereof by means of flexible inlet pipe that enlarges in diameter when subjected to such fluid pressure so that the pipe will not rupture and then returns to its normal diameter after such fluid pressure is abated.

These and other objects will be apparent to those skilled in the art.

BRIEF SUMMARY OF THE INVENTION

The present invention is directed towards a freezeless wall hydrant that has an elongated inlet pipe comprised of a hollow tube. The tube is connected to a valve and fitting assembly on its inner end for connection to a source of water under pressure. On the outer end, the tube is connected to an adjusting element with an outlet port that is associated with the valve and fitting assembly to open or close the tube to fluid flow and allow for fluid flow out of the tube when the valve is in the open position. The tube is comprised of a flexible material that enlarges in diameter in an area along its length when it is subjected to trapped fluid therein under high pressure so that the tube will not rupture. The tube returns to its normal diameter after the high fluid pressure therein is abated.

DESCRIPTION OF THE PREFERRED EMBODIMENT OF THE INVENTION

Figure 1:
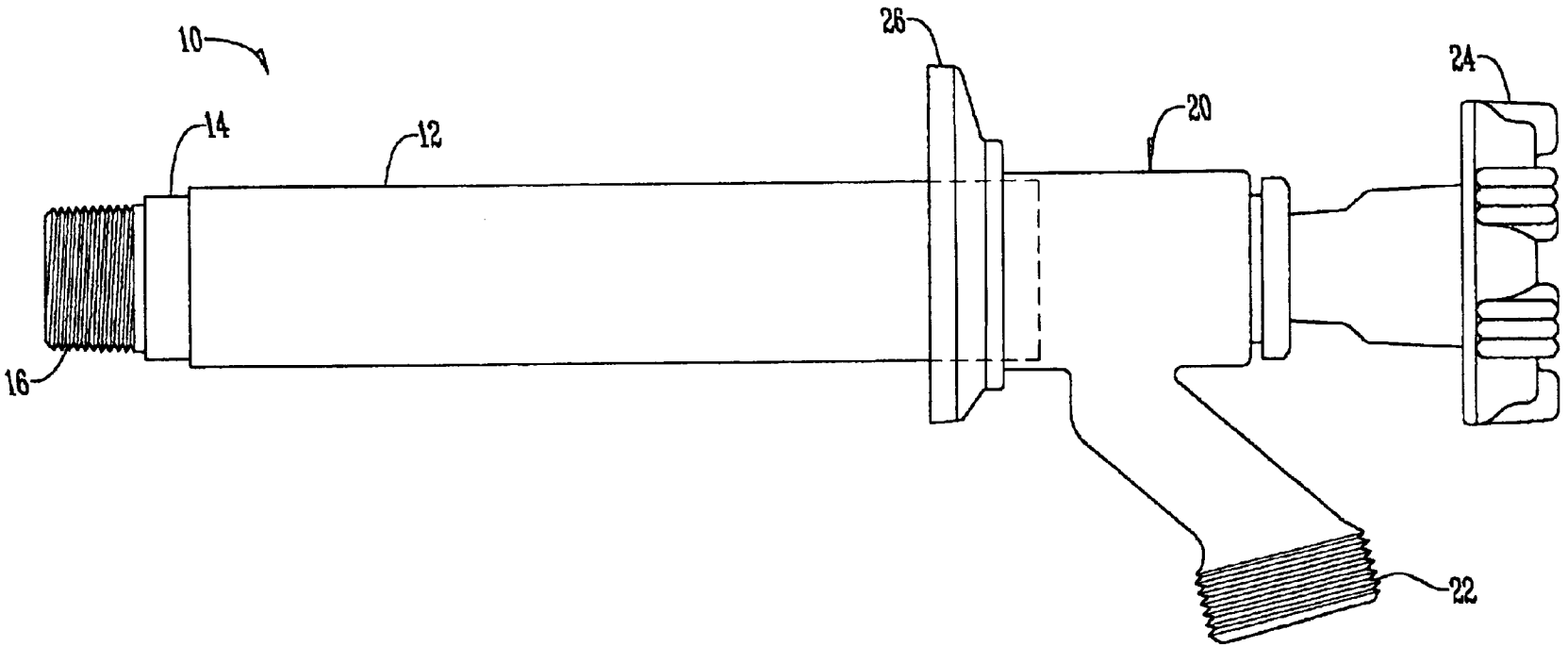
FIG. 1 is side view of the present invention during non-freezing weather when its valve is in the closed position.
Figure 2:
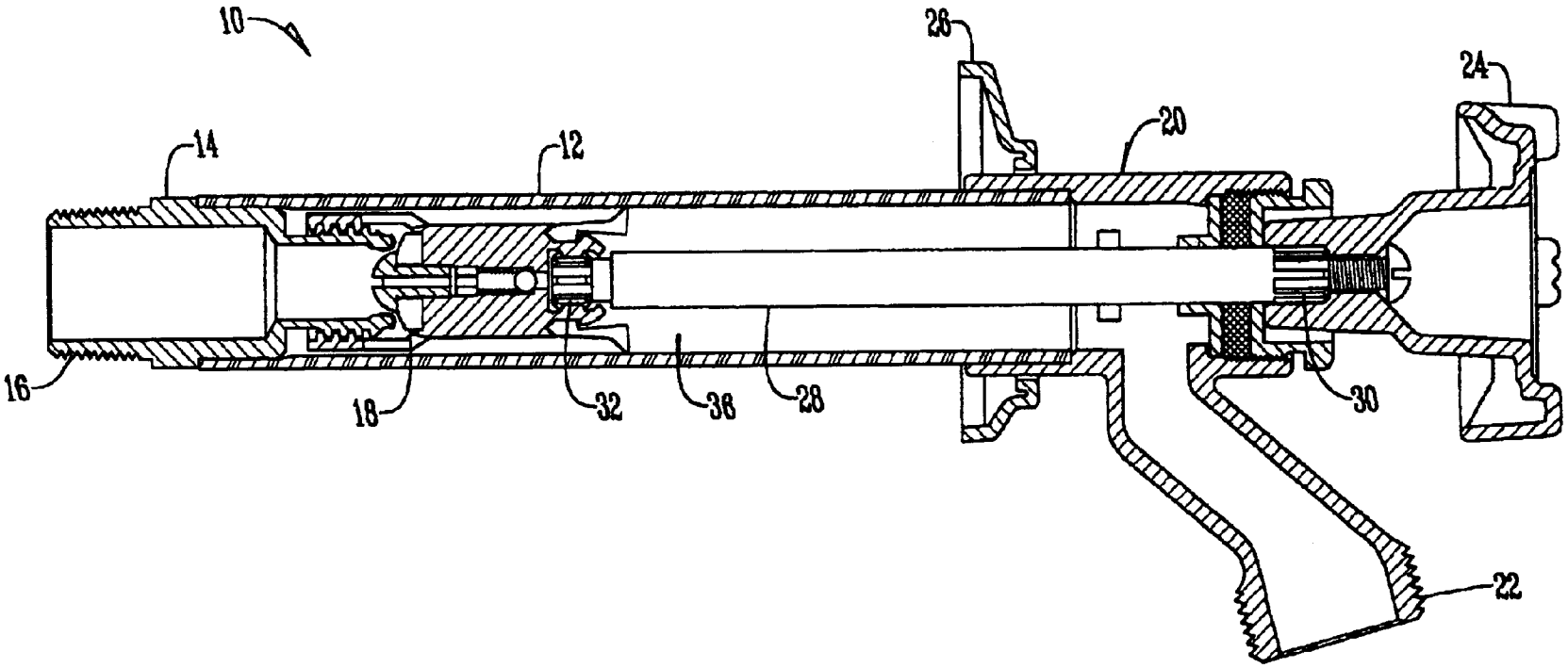
FIG. 2 is a sectional view of the present invention during non-freezing weather when its valve is in the closed position.

With reference to FIGS. 1 and 2, a freezeless wall hydrant 10 is shown having an elongated hollow inlet tube 12. Tube 12 is comprised of a flexible material, preferably rubber or plastic. The specific characteristics of tube 12 are vital to the operation of wall hydrant 10, as will be discussed hereafter.

Fitting 14 is attached to an inner end of tube 12. Fitting 14 includes a threaded inlet 16 that treadably attaches to a source of water under pressure (not shown). Fitting 14 also attaches to a valve 18 on an end opposite threaded inlet 16. Valve 18 is preferably of the needle valve type.

Body 20 attaches to an outer end of tube 12, opposite the inner end attached to fitting 14. Body 20 includes a threaded outlet port 22, an adjusting element 24 and a coupling 26. Body 20 typically is made of metal, but may be made of any number of materials. Threaded outlet port 22 has a threaded end such that a common garden hose (not shown) can threadably attach thereon. Adjusting element 24 may be made of metal or plastic. Typically, adjusting element 24 is a handle. Coupling 26 serves as a clean transition between the exterior portion of wall hydrant 10 and the interior portion, as will be discussed hereafter.

Elongated rod 28 runs within hollow tube 12 and connects adjusting element 24 to valve 18. Preferably, elongated rod 28 has a splined connection 30 that engages with adjusting element 24. Similarly, elongated rod 28 has a splined connection 32 that engages with valve 18. By rotating adjusting element 24, elongated rod 28 turns to open or close valve 18. Opening valve 18 allows the pressurized water to flow from threaded inlet 16 past valve 18 and into hollow tube 12. Closing valve 18 stops the flow of pressurized water past valve 18.

The freezeless wall hydrant 10 is installed within a wall or a warmer interior area of a building of which the wall is a part. When the wall hydrant 10 is installed, an exterior portion, which comprises body 20, will protrude from the wall. An interior portion, which includes hollow tube 12, fitting 14, and valve 18, remains within the wall. Coupling 26 serves as a clean transition between body 20 and tube 12 and covers the hole in the wall (not shown) through which body 20 emerges. As such, the source of pressurized water and valve 18 remain protected inside the wall and are not exposed to freezing outside conditions. Body 20, however, is subject to external conditions, including freezing weather.

In normal operation, a user rotates adjusting element 24 to turn the faucet "on" or "off". Rotating the adjusting element 24 turns the elongated rod 28, which opens or closes valve 18. When valve 18 opens, pressurized water flows from threaded inlet 16 past valve 18 and through hollow tube 12. Water then flows into body 20 and out faucet 22. When valve 18 is closed, pressurized water from threaded inlet 16 stops at valve 18. Because of gravity, residual water within hollow tube 12 will drain out through outlet port 22.

In freezing conditions, the operation of wall hydrant 10 depends upon whether or not a hose is attached to threaded outlet port 22. If there is no hose attached to the outlet port 22, then the wall hydrant 10 will perform in a similar manner as described above. If a hose is attached to threaded outlet port 22 during freezing conditions, residual water within the hose and faucet 20 will freeze to prevent the flow of residual water inside hollow tube 12 through outlet port 22. In fact, as residual water within the hose and body 20 freezes, it will expand, traveling up through body 20 and into hollow tube 12.

Figure 3:
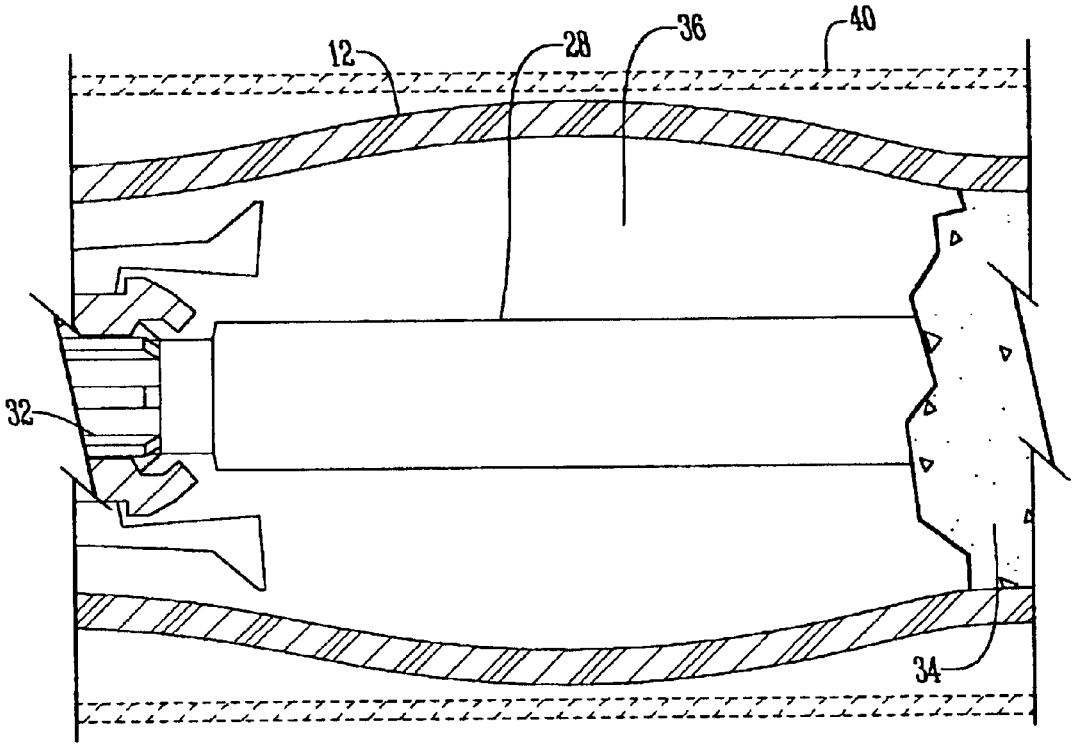
FIG. 3 is a sectional view of a portion of the elongated hollow tube of the present invention when expanded during freezing conditions.

As shown in FIG. 3, frozen residual water 34 in the faucet 20 has expanded within hollow tube 12. As the ice 34 expands further into tube 12, the residual water 36 within tube 12 is under great pressure. In most conventional wall hydrants, the inlet tube eventually will rupture under this pressure. In freezeless wall hydrant 10, however, hollow tube 12 is comprised of a flexible material such that it enlarges in diameter under the pressure of the residual water 36 trapped therein, as shown in FIG. 3. If desired, a solid support tube or sleeve 40 can be inserted over hollow tube 12 to prevent tube 12 from expanding beyond its structural capabilities. Sleeve 40 has an inner diameter greater than the outer diameter of tube 12. When exterior conditions are no longer freezing, the frozen residual water or ice 34 inside the garden hose and body 20 will thaw such that ice 34 melts and the tube 12 returns to its normal diameter, as shown in FIGS. 1 and 2, whereupon the pressure on the residual water 36 is relieved.

It is therefore seen that by the use of a flexible hollow inlet tube 12, the freezeless wall hydrant 10 can withstand internal pressure from trapped residual water 36 during freezing conditions without rupturing.

What is claimed is:

1. A freezeless wall hydrant, comprising, an elongated hollow tube comprised of flexible material and having inner and outer ends, a valve and, said valve and a portion of said fitting being disposed within the inner end, with another portion of said fitting being secured to said inner end, said inner end being connected to a source of water under pressure, an adjusting element on the outer end of the tube associated with the valve and fitting assembly to open or close the tube to fluid flow, an outlet port associated with the outer end of the tube for fluid flow out of the tub when the valve is open to fluid flow, the tube being of such flexible material that will expand in diameter in some area along its length if subjected to trapped fluid therein under high pressure so that the tube will not rupture, and wherein the tube will return substantially to its normal diameter at such time as the higher fluid pressure therein is substantially reduced.

2. The freezeless wall hydrant of claim 1 wherein the elongated hollow tube is comprised of rubber.

3. The freezeless wall hydrant of claim 1 wherein the elongated hollow tube is comprised of plastic.

4. The freezeless wall hydrant of claim 1 further comprising a solid support sleeve having an inner diameter greater than the outer diameter of the hollow tube and inserted over the hollow tube to prevent the hollow tube from expanding beyond its structural capabilities.

* * * * *